US007299845B2

(12) United States Patent
Morimoto et al.

(10) Patent No.: US 7,299,845 B2
(45) Date of Patent: Nov. 27, 2007

(54) METHOD AND APPARATUS FOR JOINING ADHESIVE TAPE

(75) Inventors: Masakazu Morimoto, Osaka (JP); Shinsuke Ikishima, Osaka (JP); Masayoshi Natsume, Osaka (JP); Shigeki Ishiguro, Osaka (JP)

(73) Assignee: Nitto Denko Corporation, Osaka (JP)

( * ) Notice: Subject to any disclaimer, the term of this patent is extended or adjusted under 35 U.S.C. 154(b) by 188 days.

(21) Appl. No.: 10/886,610

(22) Filed: Jul. 9, 2004

(65) Prior Publication Data

US 2005/0011613 A1 Jan. 20, 2005

(30) Foreign Application Priority Data

Jul. 14, 2003 (JP) ..... 2003-274048

(51) Int. Cl.
*B32B 37/00* (2006.01)

(52) U.S. Cl. ..... 156/391; 156/574

(58) Field of Classification Search ..... 156/71, 156/391, 538, 556, 574, 577, 579
See application file for complete search history.

(56) References Cited

U.S. PATENT DOCUMENTS 6,508,287 B1 1/2003 Shinozaki et al.
6,601,630 B2 * 8/2003 Kang ..... 156/574
6,748,993 B1 * 6/2004 Shinozaki et al. ..... 156/391
6,796,351 B1 * 9/2004 Maeda ..... 156/391
2002/0056525 A1 * 5/2002 Kang ..... 156/574

FOREIGN PATENT DOCUMENTS

JP 2000-238958 A1 9/2000
JP 2001123127 A * 5/2001
JP 2001-171570 A1 6/2001
JP 2001-328573 A1 11/2001

OTHER PUBLICATIONS

European Search Report for application No. EP04016232 completed on Nov. 9, 2004.

* cited by examiner

*Primary Examiner*—James Sells
(74) *Attorney, Agent, or Firm*—Rader, Fishman & Grauer PLLC

(57) ABSTRACT

An adhesive tape inserted into a tape inserting clearance defined between a tape supplying roller and a tape guide is supplied to joining rollers while being wound around the tape supplying roller under guidance. At the tape inserting clearance, one side edge of the adhesive tape is guided to a tape positioner in slide contact, to be positioned in a tape width direction, and further, the adhesive tape T is inserted and moved while allowing the tape to be moved toward the other side edge of the adhesive tape.

10 Claims, 6 Drawing Sheets

METHOD AND APPARATUS FOR JOINING ADHESIVE TAPE

BACKGROUND OF THE INVENTION (1) Field of the Invention

The present invention relates to an adhesive tape joining method, which is used in the case where, for example, an adhesive tape is joined to a curved workpiece such as a door sash in an automobile, and an adhesive tape joining apparatus for use in the method.

(2) Description of the Related Art

In recent years, there has been developed a technique of joining a black adhesive tape in place of black coating applied to a door sash in the process of manufacturing an automobile. There has been proposed means for supplying and joining an adhesive tape, which is formed into a curved shape in conformity with a curve of a tape joined surface in a workpiece, to a pressing roller while a joining apparatus is moved along the workpiece under guidance (see, for example, JP-A 2001-328573).

The above-proposed adhesive tape joining apparatus has a feature in that the adhesive tape can be smoothly joined onto the curved workpiece without requiring any large-scale equipment. However, it still has plenty of room for improvement in joining performance at the curved portion of the workpiece.

That is to say, in the above-proposed apparatus, the supplied adhesive tape is inserted into a tape guide formed between a pressing roller (i.e., a joining roller) and an openable tape guide plate, and then, is wound around the pressing roller, to be thus guided to a portion to be joined. In this manner, the adhesive tape travels through the tape guide in a state held between the pressing roller and the tape guide plate.

When the adhesive tape passes the curved portion of a tape joined surface in the workpiece as the joining work proceeds, the curved portion of the adhesive tape in conformity with the curve of the joined surface also is supplied under the guidance. However, as described above, a winding starting portion of the adhesive tape around the pressing roller is held between the pressing roller and the tape guide plate, and further, the pressing roller is covered with a rubber-like elastic member, thereby reducing the slidability of the surface and making it difficult to shift the adhesive tape, so that the adhesive tape is turned into a restricted state in which the orientation or position of the adhesive tape is hardly changed. Consequently, when the curved portion of the adhesive tape is guided at the portion restricted as described above, a side end edge of the tape is strongly pressed or scraped against a positioning surface, and as a result, a crease is liable to be generated on the adhesive tape. Therefore, when the adhesive tape passes the curved portion at the tape joined surface, the adhesive tape is made to pass slowly and carefully while taking well the timing between the moving speed of the apparatus and the change in posture of the apparatus. Thus, a further improvement has been desired from the viewpoint of handability.

SUMMARY OF THE INVENTION

The present invention has been accomplished in view of the above circumstances. Therefore, an object of the present invention is to provide an adhesive tape joining method capable of smoothly joining an adhesive tape to a curved portion at a tape joined surface with ease without requiring a particularly careful operation, and an apparatus therefor.

In order to achieve the above-described object, the present invention adopts the following configurations.

In an adhesive tape joining method for supplying an adhesive tape formed into a curved shape in conformity with a curve of a tape joined surface in a workpiece to a joining roller while moving the adhesive tape along the workpiece having the curved tape joined surface, and then, joining the adhesive tape to the tape joined surface under pressure, the method comprises the steps of: supplying the adhesive tape inserted into a tape inserting clearance defined between the tape supplying roller and a tape guide to the joining roller while winding the adhesive tape by the tape supplying roller under guidance; and slidably guiding one side edge of the adhesive tape to a tape positioner so as to position one side edge of the adhesive tape in a tape width direction at the tape inserting clearance, and further, inserting and moving the adhesive tape while allowing the adhesive tape to be moved toward the other side edge of the adhesive tape.

In the adhesive tape joining method according to the present invention, the adhesive tape pressed by the joining roller is continuously joined to the tape joined surface extending linearly or substantially linearly in the workpiece by guiding and supplying the adhesive tape to the joining roller via the tape supplying roller while moving the joining roller along the workpiece in the predetermined posture. In this case, one side edge of the adhesive tape is guided to the tape positioner in slide contact at the tape inserting clearance defined between the tape supplying roller and the tape guide, to be thus positioned in the tape width direction, so that the adhesive tape can be joined in parallel to the tape joined surface without any misalignment in the tape width direction.

Furthermore, when the apparatus reaches the curved portion at the tape joined surface as the joining work proceeds, the postures of the joining roller and the tape supplying roller are changed according to the curve of the workpiece. Here, the adhesive tape used has been previously formed into a curve in conformity with the curve of the tape joined surface in the workpiece. The adhesive tape is wound at the curved portion thereof around the tape supplying roller under the guidance.

In this case, the tape inserting clearance defined between the tape supplying roller and the tape guide is not so narrow as to hold the adhesive tape, and it is adapted to guide only one side edge of the adhesive tape in slide contact with a margin to such an extent to prevent any large detachment of the adhesive tape from the tape supplying roller. Moreover, the adhesive tape can be readily moved in the tape width direction even in a state the state where the adhesive tape is wound around the tape supplying roller by the surface slidability of the tape supplying roller per se. As a consequence, the curved portion of the adhesive tape cannot be restricted at the tape inserting clearance, but can freely pass there, thereby preventing any generation of a crease on the adhesive tape under forcible guidance.

When the apparatus reaches another linear or substantially linear tape joined surface through the curved portion of the tape joined surface, the joining roller is moved along the workpiece while keeping again the joining roller in the predetermined posture with respect to the workpiece, the adhesive tape is continuously supplied and joined while one side edge of the adhesive tape is positioned in slide contact at the tape inserting clearance.

Thus, the adhesive tape can be smoothly and readily joined at the curved portion at the tape joined surface without any generation of a crease without necessity of special careful operation.

Furthermore, in order to achieve the above-described object, the present invention also adopts the following configurations.

In an adhesive tape joining apparatus for joining an adhesive tape formed into a curved shape in conformity with a curve of a tape joined surface to a workpiece having the curved tape joined surface, the apparatus comprises: a traveling and guiding first guide roller which is rolled and moved in engagement with a part of the workpiece in a main body moved and operated along the tape joined surface in the workpiece; a plurality of posture holding guide rollers for holding the main body with respect to the workpiece in a predetermined posture under guidance in contact with another surface of the workpiece; a joining roller for joining the supplied adhesive tape to the tape joined surface of the workpiece under elastic pressure; a tape supplying roller for introducing the adhesive tape to the joining roller under winding guidance; and a tape guide for preventing any tape separation, disposed in parallel and opposite to the tape supplying roller with a clearance. In the apparatus, one end in a tape width direction of the tape inserting clearance defined between the tape supplying roller and the tape guide is released, and further, a tape positioner for receiving and guiding one side edge of the adhesive tape is formed at the other end of the tape inserting clearance.

In the adhesive tape joining apparatus according to the present invention, the curved portion of the adhesive tape cannot be restricted at the tape inserting clearance but can freely pass through the curved portion by releasing one end in the tape width direction of the tape inserting clearance defined between the tape supplying roller and the tape guide, and further, forming the tape positioner for receiving and guiding one side edge of the adhesive tape at the other end of the tape inserting clearance.

Incidentally, it is preferable that a groove should be formed on the peripheral side of the first guide roller. With this configuration, the first guide roller is rolled and moved in engagement with a part of the workpiece, and further, the function of allowing an operator to perceive the arrival at the curved portion with a dynamic resistance or the like can be exhibited.

Moreover, it is preferable that there should be provided a plurality of second guide rollers disposed in series in a disposing direction, wherein the first guide roller is located forward in a moving direction. With this configuration, it is possible to stabilize the traveling guidance of the rolling movement in the adhesive tape joining apparatus.

Additionally, it is preferable that the tape positioner should be provided with a flat surface along a tape longitudinal direction, and further, a corner on a tape introducing-in side at the flat surface is formed into a curved surface. It is more preferable that a corner on a tape introducing-out side in the tape positioner should be formed into a curved surface. With this configuration, it is possible to preferably position one side edge of the adhesive tape in the tape width direction by smoothly guiding one side edge of the adhesive tape in slide contact at the flat surface of the tape positioner in the process of joining the linear or substantially linear tape. In addition, when the curved portion of the adhesive tape passes through the tape inserting clearance, the adhesive tape can be smoothly moved in slide contact without any hooking or interference even if the side edge of the adhesive tape acts on the corner on the tape introducing side at the flat surface.

Furthermore, the tape positioner may be configured in such a manner as to position the side edge of the adhesive tape at a curved surface of a pin, or the tape positioner may be configured in such a manner as to position the side edge of the adhesive tape at a curved surface of a roller supported by a pin in a loosely rotatable manner.

Moreover, it is preferable that the joining roller should be covered at the surface thereof with a spongy rubber layer. With this configuration, since the rubber layer is elastically deformed, the adhesive tape can be joined to the workpiece under appropriate pressure.

Additionally, it is preferable that the surface of the tape supplying roller should be made of a material excellent in slidability with respect to the adhesive tape. With this configuration, the adhesive tape can be readily moved in the tape width direction even in a state where the adhesive tape is wound around the tape supplying roller by the surface slidability of the tape supplying roller per se. As a consequence, it is possible to prevent any generation of a crease on the adhesive tape by friction or resistance.

In addition, it is preferable that each of the first guide roller, the posture holding guide roller and the joining roller should be positionally adjusted according to the specifications of the workpiece. With this configuration, it is possible to smoothly and readily join the tape at the curved portion at the tape joined surface without any generation of a crease irrespective of the specifications of the workpiece.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Description will be given below of an adhesive tape joining apparatus in a preferred embodiment according to the present invention in reference to the drawings.

Figure 1:
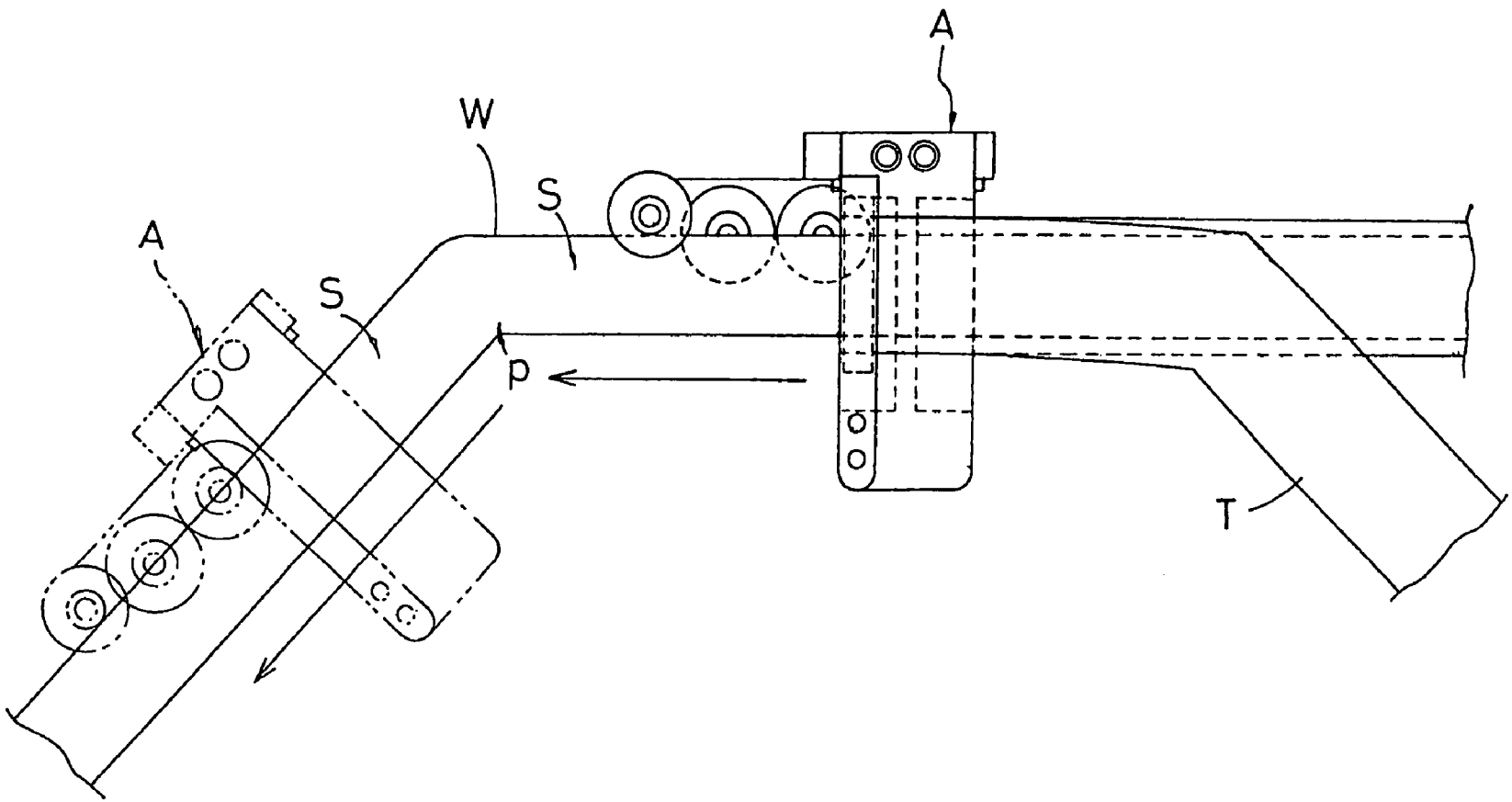
FIG. 1 is a front view showing a joining state by the use of an adhesive tape joining apparatus according to the present invention.
Figure 2:
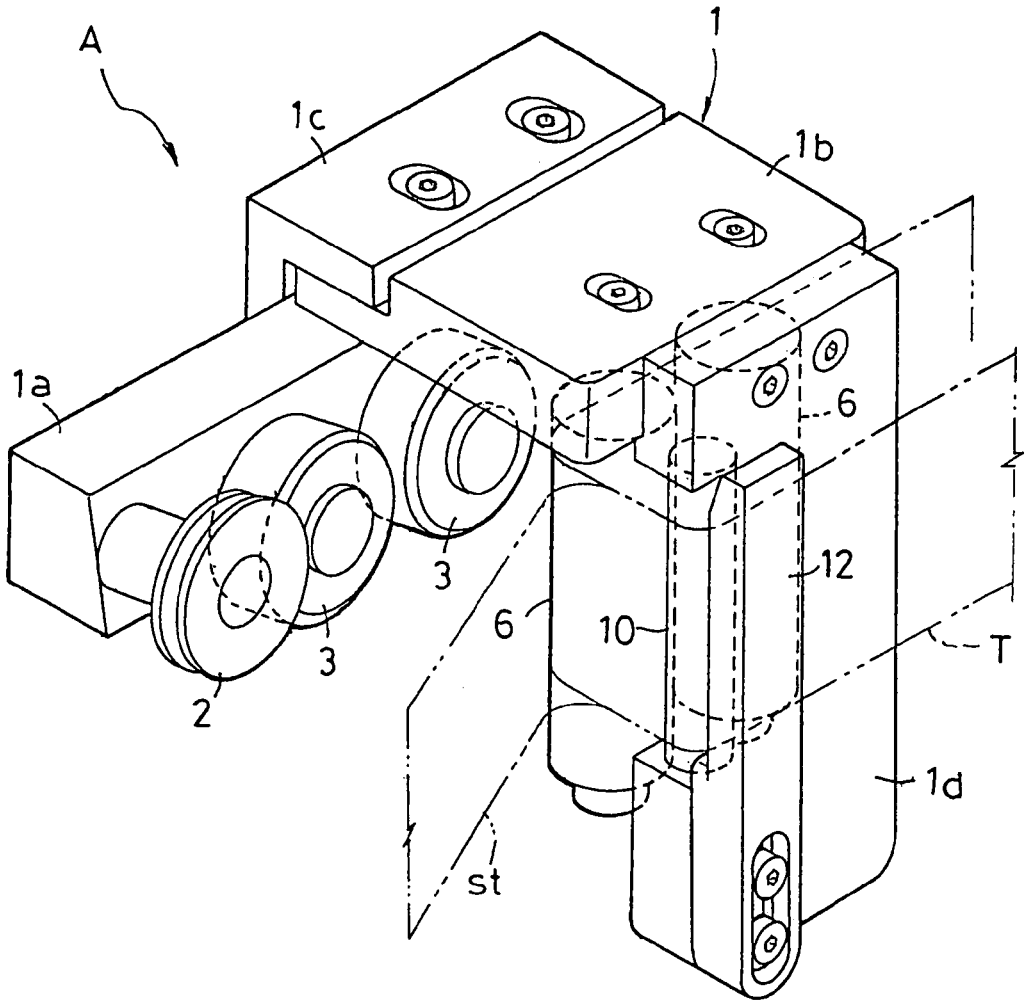
FIG. 2 is a perspective view showing the adhesive tape joining apparatus.
Figure 3:
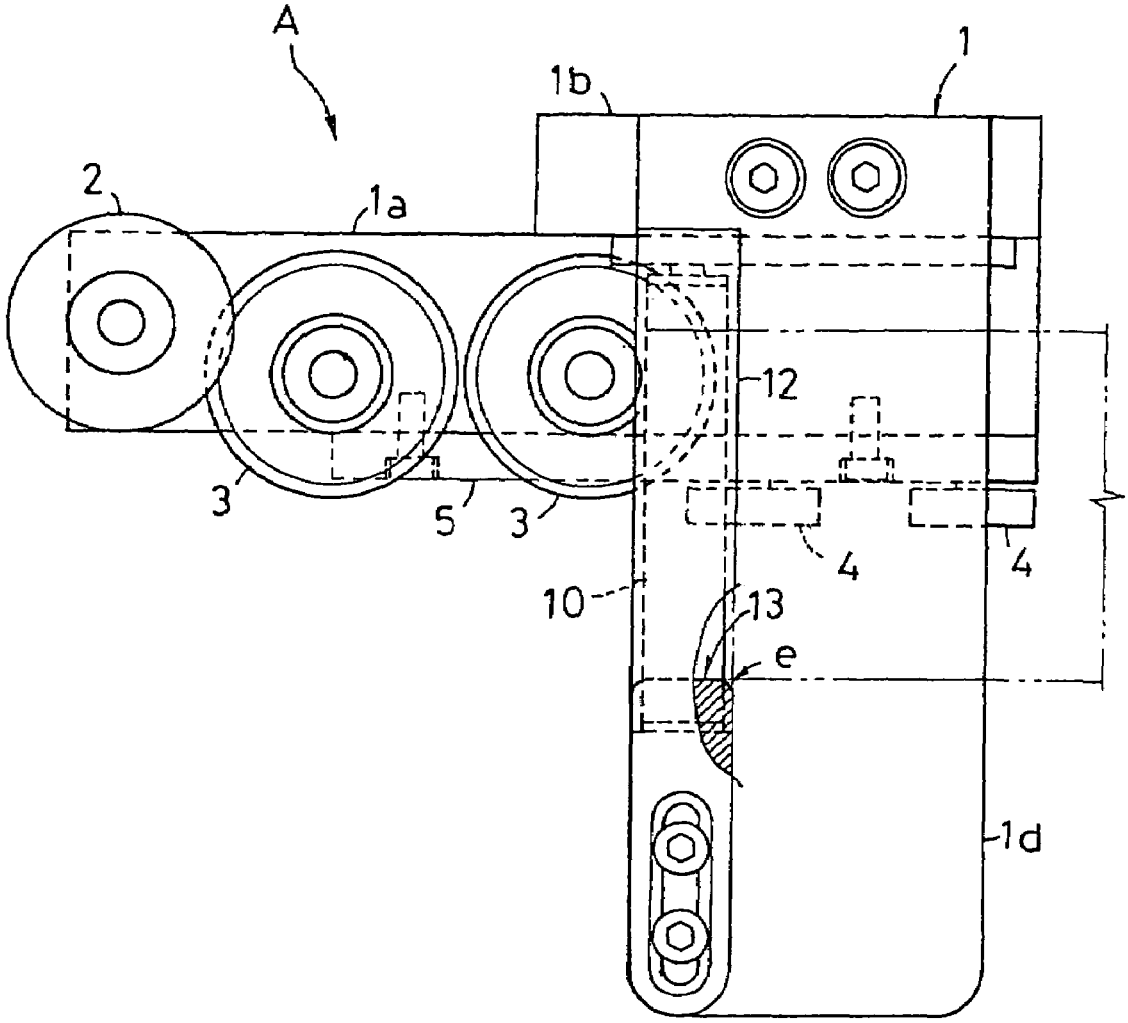
FIG. 3 is a partly cutaway front view showing the adhesive tape joining apparatus.

Here, FIG. 1 is a front view showing a process of joining an adhesive tape T onto a curved workpiece W by the use of an adhesive tape joining apparatus A according to the present invention; FIG. 2 is a perspective view showing the outside appearance of the adhesive tape joining apparatus A; and FIG. 3 is a front view showing the adhesive tape joining apparatus A. The workpiece W in the preferred embodiment is a door sash in an automobile. A black adhesive tape is joined onto a curved side surface of the door sash in place of black coating.

Figure 6:
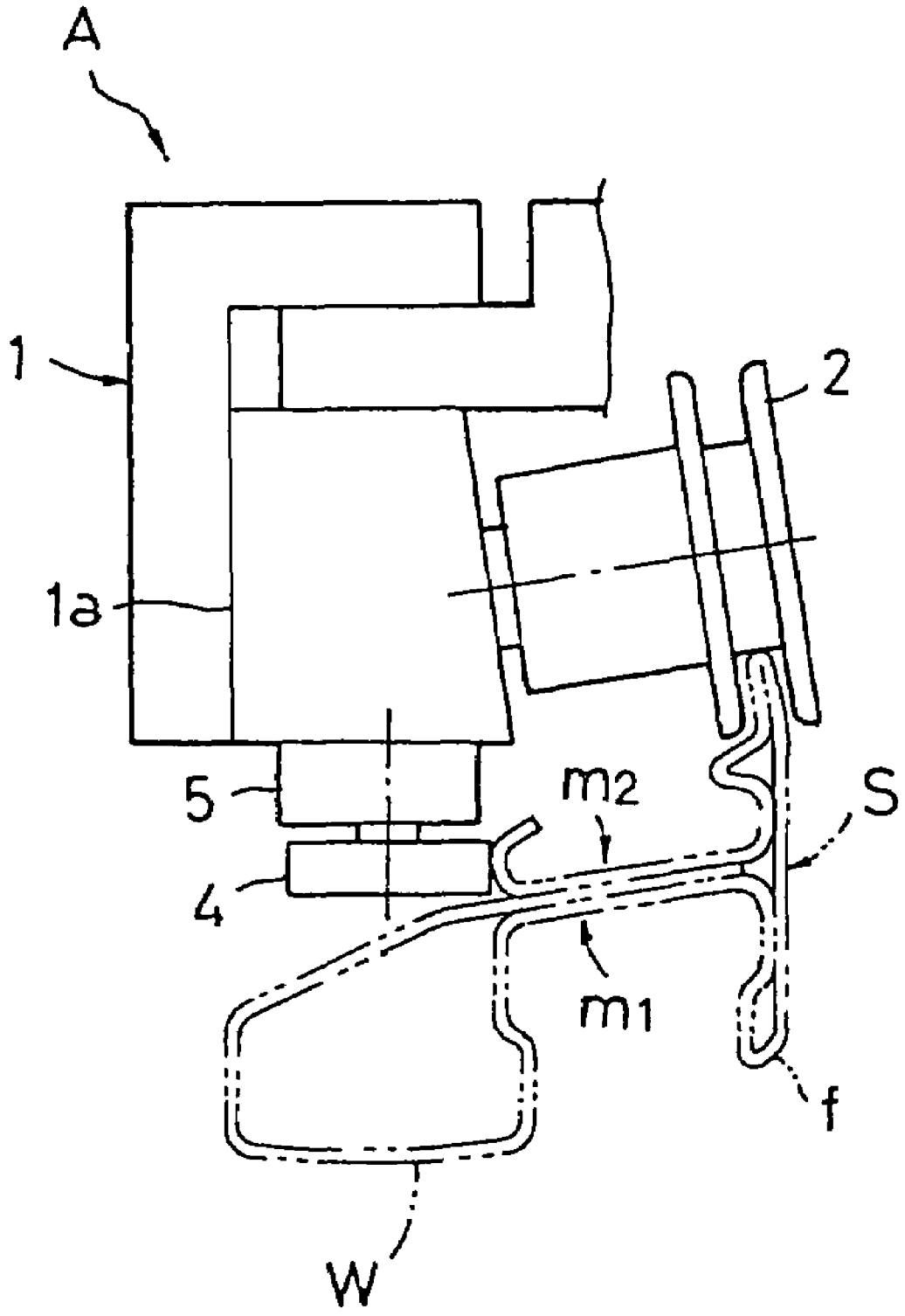
FIG. 6 is a side view showing a part of the adhesive tape joining apparatus.

The workpiece W is obtained by curving a peripheral frame member made of sheet metal having a cross-sectional shape shown in FIG. 6 into a desired shape by welding connection. A window glass inserting groove m1 is formed at the inner circumference, and further, a weather strip attaching groove m2 is formed at the outer periphery. A side surface of a T-shaped peripheral flame f forming these grooves is a tape joined surface S.

As shown in FIG. 1, an adhesive tape with a separator wider than the curved tape joined surface S of the workpiece W is used as the adhesive tape T, which has been previously cut out in a curved shape in conformity with the curve of the tape joined surface S.

As shown in FIG. 2, the adhesive tape joining apparatus A is manually moved along a workpiece longitudinal direction in engagement with the workpiece W under guidance. A main body 1 in the adhesive tape joining apparatus A is configured by sequentially bolting a first bracket 1*a* formed into a square rod elongated in an apparatus traveling direction, a thick second bracket 1*b* flat in a vertical direction, a connecting third bracket 1*c* curved in an L shape and a vertically plate-like fourth bracket 1*d*. Incidentally, in description hereinafter for the sake of convenience, a direction X in which the apparatus is moved during a joining operation is referred to as forward; in contrast, a direction perpendicular to the direction X is referred to as a lateral direction.

As shown in FIGS. 2 and 3, at a lateral side surface of the first bracket 1*a*, a first guide roller 2 with a groove, which can be loosely rotated on a slightly inclined lateral axis, and two second guide rollers 3 are disposed in series in the apparatus traveling direction with the first guide roller 2 located forward. At the rear portion at the lower surface of the first bracket 1*a* is disposed a pair of forward and backward third guide rollers 4 loosely rotated on a vertical axis via a support plate 5.

Here, the first guide roller 2 with a groove engages with an upper end edge of the T-shaped peripheral flame f in the workpiece W, as shown in FIG. 6, so as to guide the adhesive tape joining apparatus A forward X, and further, is first brought into contact with a welded point of the curved portion of the workpiece W, so as to exhibit the function of allowing an operator to perceive the arrival at the curved portion by movement resistance or the like. Here, the first guide roller 2 corresponds to a first guide roller for traveling and guiding according to the present invention.

The two second guide rollers 3 are deeply inserted down to the bottom surface of the weather strip attaching groove m2 in the workpiece W, and further, the two third guide rollers 4 are pressed in contact with the side frame of the weather strip attaching groove m2. A group consisting of these guide rollers is pressed against and engages with a predetermined portion of the workpiece W, so that the adhesive tape joining apparatus A is such configured as to engage with the workpiece W in a predetermined joining posture under the guidance. Here, the second guide roller 3 corresponds to a second guide roller according to the present invention, and further, the third guide roller 4 corresponds to a posture holding guide roller according to the present invention.

Figure 4:
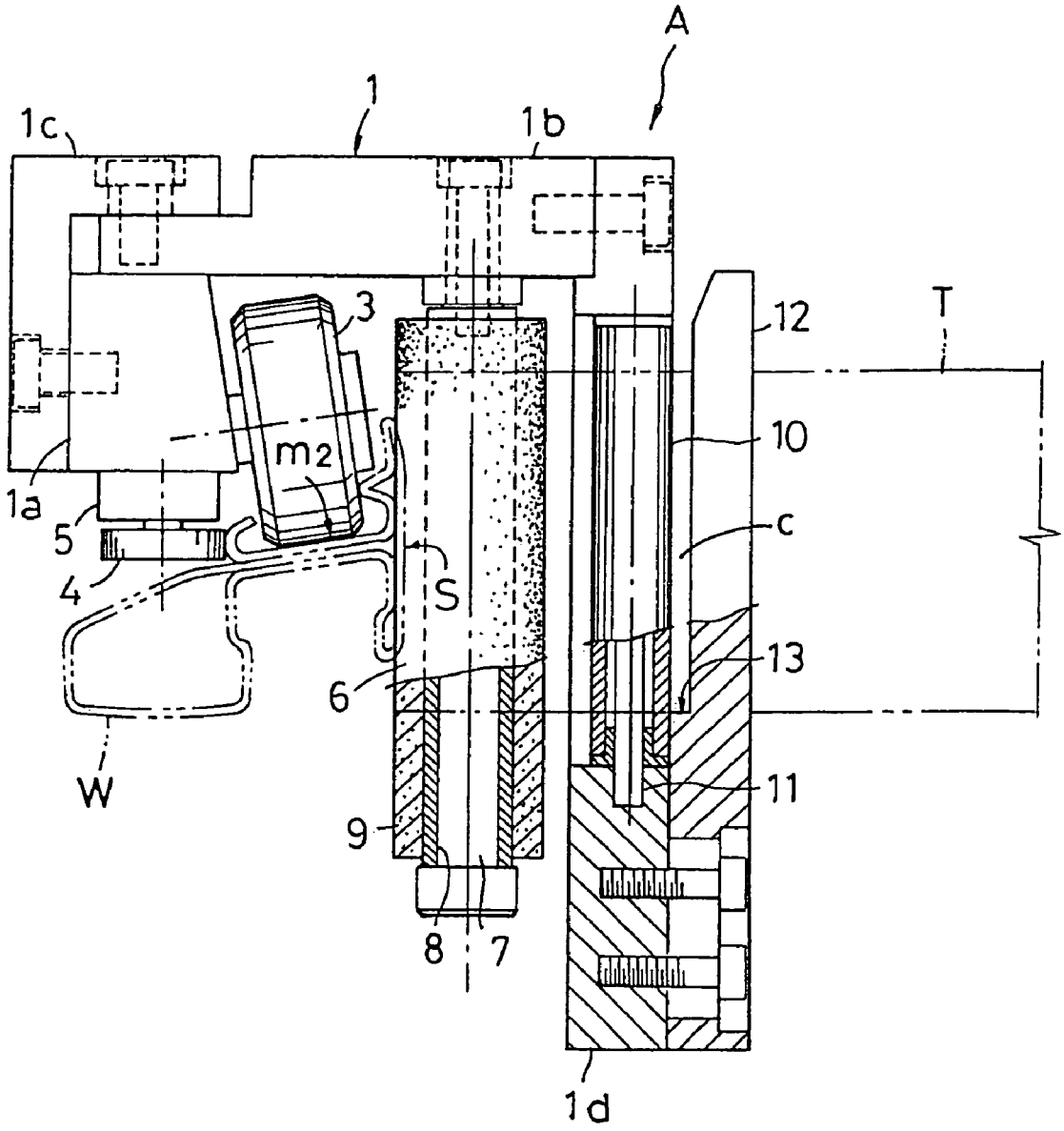
FIG. 4 is a partly cutaway side view showing the adhesive tape joining apparatus.
Figure 5:
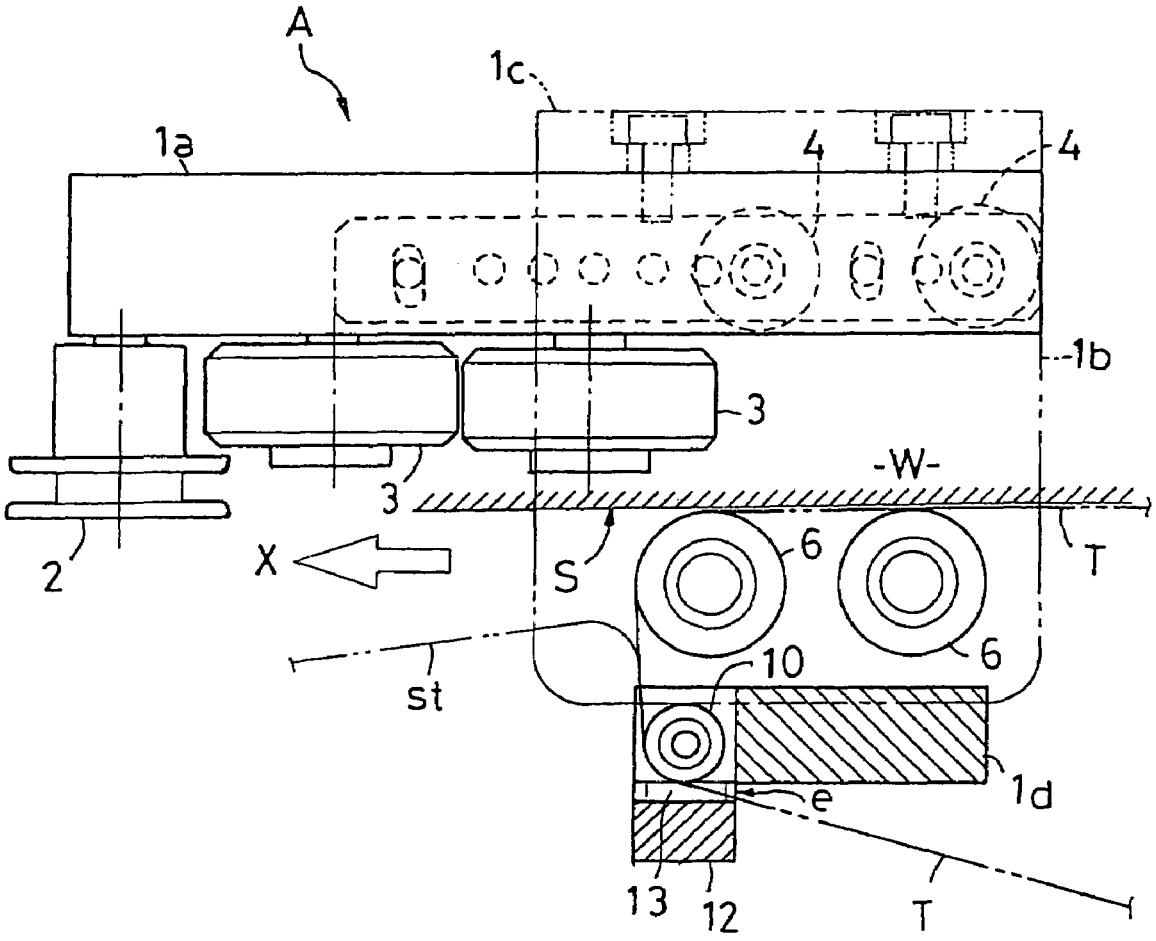
FIG. 5 is a plan view showing the adhesive tape joining apparatus, in which essential parts are shown in cross section.

As shown in FIG. 4, at the lower surface of the second bracket 1*b* are pivoted a pair of forward and backward joining rollers 6 in a loosely rotatable manner on a vertical axis. The joining roller 6 is configured by covering a cylindrical shaft 8 fitted around a fixed core shaft 7 in a loosely rotatable manner with a spongy rubber layer 9. In a state where the adhesive tape joining apparatus A engages with the workpiece W in a predetermined posture, the joining roller 6 is positionally set in such a manner that the outer periphery of the joining roller 6 is pressed against the tape joined surface S of the workpiece W while being elastically deformed on an appropriate level.

At the fore portion of the fourth bracket 1*d* connected to the lateral outer end of the third bracket 1*b* so as to extend downward is pivoted a tape supplying roller 10 in parallel to the front joining roller 6 in a loosely rotatable manner on a vertical axis. The tape supplying roller 10 is made of a hard resin material excellent in slidability, to be supported by a fixed strut 11 in a loosely fitted manner.

At the lower portion at the lateral outer surface of the third bracket 1*b* is securely fixed to a tape guide 12, which is formed into a square rod and is made of a hard resin material. The tape guide 12 is erected in an upward cantilever fashion in such a manner as to face the tape supplying roller 10 with a tape inserting clearance c which is sufficiently greater than the thickness of the tape. The tape inserting clearance c is released upward, and further, a tape positioner 13 having a flat surface at the lower end of the tape inserting clearance c is formed stepwise. A lower side edge of the adhesive tape T inserted into the tape inserting clearance c is received and supported by the tape positioner 13, so that the adhesive tape T is positioned in the width direction. As shown in FIG. 3, a corner e on each of the tape introducing side and opposite side of the tape positioner 13 is formed into a curved surface having a relatively great curvature.

The adhesive tape joining apparatus A according to the present invention is configured as described above. Subsequently, an adhesive tape joining process by the use of the above-described adhesive tape joining apparatus A will be explained below in reference to FIG. 1.

First, the adhesive tape T with a separator is insertingly loaded in the adhesive tape joining apparatus A in engagement with the workpiece W in the predetermined posture via the group consisting of the guide rollers. That is to say, the adhesive tape T inserted into the tape inserting clearance c is introduced to the joining rollers 6 under the guidance of the tape supplying roller 10.

Next, a separator st is separated from one end of the adhesive tape T, thus exposing an adhesive surface. The adhesive surface is manually positioned at and joined to one end of the joined surface S in the workpiece w.

Thereafter, the adhesive tape T having the exposed adhesive surface is wound around the joining rollers 6 and elastically pressed against the joined surface S while separating the separator st in front of the joining rollers 6. In this state, the adhesive tape joining apparatus A is moved forward X along the workpiece W, so that the adhesive tape T can be sequentially joined onto the tape joined surface S while positioning the adhesive tape T.

When the first guide roller 2 with the groove in contact with the welded point of a curved portion p is perceived by the operator, the fore half of the tape joined surface S is finished joining. At this time, the posture of the adhesive tape joining apparatus A is varied in conformity with the curve of the workpiece W. In this case, the curved portion of the adhesive tape T passes through the tape inserting clearance c defined between the tape supplying roller 10 and the tape guide 12. The tape inserting clearance c is sufficiently greater than the thickness of the tape, and further, the adhesive tape T can be readily moved in the tape width direction by the surface slidability of the tape supplying roller 10 per se even in the state where the adhesive tape T is wound around the tape supplying roller 10. As a consequence, the curved portion of the adhesive tape T cannot be restricted at the tape inserting clearance c but can freely pass therethrough. Thus, no crease is generated on the adhesive tape T caused by forcible guidance.

When the adhesive tape joining apparatus A passes the curved portion of the tape joined surface S and reaches another linear or substantially linear tape joined surface S, the adhesive tape joining apparatus A is moved forward along the workpiece W while keeping the adhesive tape joining apparatus A in the predetermined posture with respect to the workpiece W; thus, the adhesive tape is continued to be joined to the rear half of the tape joined surface S in the same manner as with respect to the fore half.

In this case, the tape positioner 13 positions one side edge of the adhesive tape T in the tape width direction under smooth guidance in slide contact with the flat surface in the process of joining the tape in a linear or substantially linear manner. Furthermore, since the corner e is formed into a curve even if the side edge of the adhesive tape T acts on the corner e on the tape introducing side of the tape positioner 13 when the curved portion of the adhesive tape T passes through the tape inserting clearance c, the adhesive tape T cannot be hooked on or interfere with the corner e, so that the adhesive tape T can smoothly pass through the tape inserting clearance c.

Incidentally, a tape portion extending from the tape joined surface S is folded back and joined to the back side of the T-shaped peripheral flame f having the tape joined surface S in a post process, so that the outside appearance similar to that obtained by a coating process can be obtained.

In the meantime, the position of the group consisting of the guide rollers and the position of the joining roller 6 need be adjusted with respect to a workpiece W of other specifications. In view of this, the first bracket 1*a* is connected to the third bracket 1*c* in a positionally adjustable manner in the forward and backward direction; the support plate 5 having the third guide rollers 4 fixed thereto is secured to the first bracket 1*a* in a positionally adjustable manner in the lateral direction; the second bracket 1*b* is connected to the third bracket 1*c* in a positionally adjustable manner in the lateral direction; and the joining rollers 6 per se are connected to the second bracket 1*b* in a positionally adjustable manner in the lateral direction. Moreover, the tape positioner 13 can be positionally adjusted in the tape width direction by positionally adjusting the tape guide 12 in the vertical direction according to variations in tape width.

The present invention is not limited to the above-described embodiment, but it can be modified as follows.

(1) Although the third guide rollers are provided in the preferred embodiment, no third guide roller may be provided in a modification.

(2) Although the tape positioner 13 having the flat surface is stepwise formed at the lower end of the tape inserting clearance c in the above-described embodiment, another modification may be configured as follows. For example, the side edge of the adhesive tape T may be positioned by a pin or at a curve of a roller supported by a pin in a loosely rotatable manner, or a rod-like member having a curved corner formed thereat may be pivoted at the center thereof in such a manner that both ends thereof are oscillated vertically. With this configuration, the same effects as those in the above-described embodiment can be produced.

The present invention may be embodied in other specific forms without departing from the spirit or essential attributes thereof and, accordingly, reference should be made to the appended claims, rather than to the foregoing specification, as indicating the scope of the invention.

What is claimed is:

1. An adhesive tape joining apparatus for joining an adhesive tape formed into a curved shape in conformity with a curve of a tape joined surface to a workpiece having the curved tape joined surface, the apparatus comprising:

a traveling and guiding first guide roller having a groove extending radially into and circumferentially around an outer periphery of the traveling and guiding first guiding roller, the traveling and guiding first guiding roller being rolled in a forward direction and moved in engagement with a part of the workpiece in a main body moved and operated along the tape joined surface in the workpiece;

a plurality of posture holding guide rollers for holding the main body with respect to the workpiece in a predetermined posture under guidance in contact with another surface of the workpiece, the plurality of posture holding guide rollers being rolled in the forward direction one behind another;

a joining roller for joining the supplied adhesive tape to the tape joined surface of the workpiece under elastic pressure;

a tape supplying roller for introducing the adhesive tape to the joining roller under winding guidance; and a tape guide for preventing any tape separation, disposed in parallel and opposite to the tape supplying roller with a clearance, wherein one end in a tape width direction of the tape inserting clearance defined between the tape supplying roller and the tape guide is released, thereby a tape positioner is formed for positioning the tape in the tape width direction by slidably guiding one side edge of the adhesive tape at an inner end of the tape inserting clearance, and the adhesive tape is inserted and moved while allowing the tape to be moved toward a releasing side edge of the adhesive tape opposite to the tape positioner, and wherein at least one of the plurality of posture holding guide rollers is disposed in front of the tape supplying roller relative to the forward direction and the traveling and guiding first guide roller is disposed in front of the at least one of the plurality of posture holding guide rollers relative to the forward direction.

2. An adhesive tape joining apparatus according to claim 1, wherein a groove is formed on the peripheral side of the first guide roller.

3. An adhesive tape joining apparatus according to claim 2, further comprising:

a plurality of second guide rollers disposed in series in a disposing direction, wherein the first guide roller is located forward in a moving direction.

4. An adhesive tape joining apparatus according to claim 1, wherein the tape positioner is provided with a flat surface along a tape longitudinal direction, and a corner on a tape introducing-in side at the flat surface is formed into a curved surface.

5. An adhesive tape joining apparatus according to claim 4, wherein a corner on a tape introducing-out side in the tape positioner is formed into a curved surface.

6. An adhesive tape joining apparatus according to claim 1, wherein the tape positioner is configured in such a manner as to position the side edge of the adhesive tape at a curved surface of a pin.

7. An adhesive tape joining apparatus according to claim 1, wherein the tape positioner is configured in such a manner as to position the side edge of the adhesive tape at a curved surface of a roller supported by a pin in a loosely rotatable manner.

8. An adhesive tape joining apparatus according to claim 1, wherein the joining roller is covered at the surface thereof with a spongy rubber layer.

9. An adhesive tape joining apparatus according to claim 1, wherein the surface of the tape supplying roller is made of a material excellent in slidability with respect to the adhesive tape.

10. An adhesive tape joining apparatus according to claim 1, wherein each of the first guide roller, the posture holding guide roller and the joining roller can be positionally adjusted according to the specifications of the workpiece.

* * * * *